US005308160A

United States Patent [19]

Weiss

[11] Patent Number: 5,308,160

[45] Date of Patent: May 3, 1994

[54] PROCESS AND DEVICE FOR THE MIXING OF BEVERAGE COMPONENTS

[75] Inventor: Wilhelm Weiss, Lappersdorf, Fed. Rep. of Germany

[73] Assignee: Krones AG Hermann Kronseder Maschinenfabrik, Neutraubling, Fed. Rep. of Germany

[21] Appl. No.: 969,246

[22] PCT Filed: Jul. 8, 1992

[86] PCT No.: PCT/EP92/01540

§ 371 Date: Feb. 24, 1993

§ 102(e) Date: Feb. 24, 1993

[87] PCT Pub. No.: WO93/00988

PCT Pub. Date: Jan. 21, 1993

[30] Foreign Application Priority Data

Jul. 12, 1991 [DE] Fed. Rep. of Germany ..... 4123047

[51] Int. Cl.[5] ..... B01F 15/04

[52] U.S. Cl. ..... 366/160; 99/275

[58] Field of Search ..... 366/160, 161, 162, 152, 366/19, 16; 137/3, 98, 9, 87, 88, 100; 222/55, 134; 99/275

[56] References Cited

U.S. PATENT DOCUMENTS 4,440,314 4/1984 Vetter ..... 366/160
4,784,495 11/1988 Jonsson ..... 366/160

FOREIGN PATENT DOCUMENTS

0172000A2 2/1986 European Pat. Off. .
31322706A1 3/1983 Fed. Rep. of Germany .
781818 7/1955 United Kingdom .

*Primary Examiner*—Robert W. Jenkins
*Attorney, Agent, or Firm*—Finnegan, Henderson, Farabow, Garrett & Dunner

[57] ABSTRACT

In a process for the mixing of beverage components, in particular syrup and water, in which a first component is introduced from a storage chamber into a measuring chamber with a specific volume and a second component is metered in accordance with the volume and the desired mixing ratio and both components are then discharged into a collecting chamber, when the measuring chamber can only partly be filled upon the introduction of the first component from an insufficiently filled storage chamber, the amount of the first component introduced into the measuring chamber is measured and the second component is subsequently metered according to the measured amount of the first component. In this fashion, small residual amounts of syrup can be conveniently processed with a consistently high mixing accuracy.

12 Claims, 1 Drawing Sheet

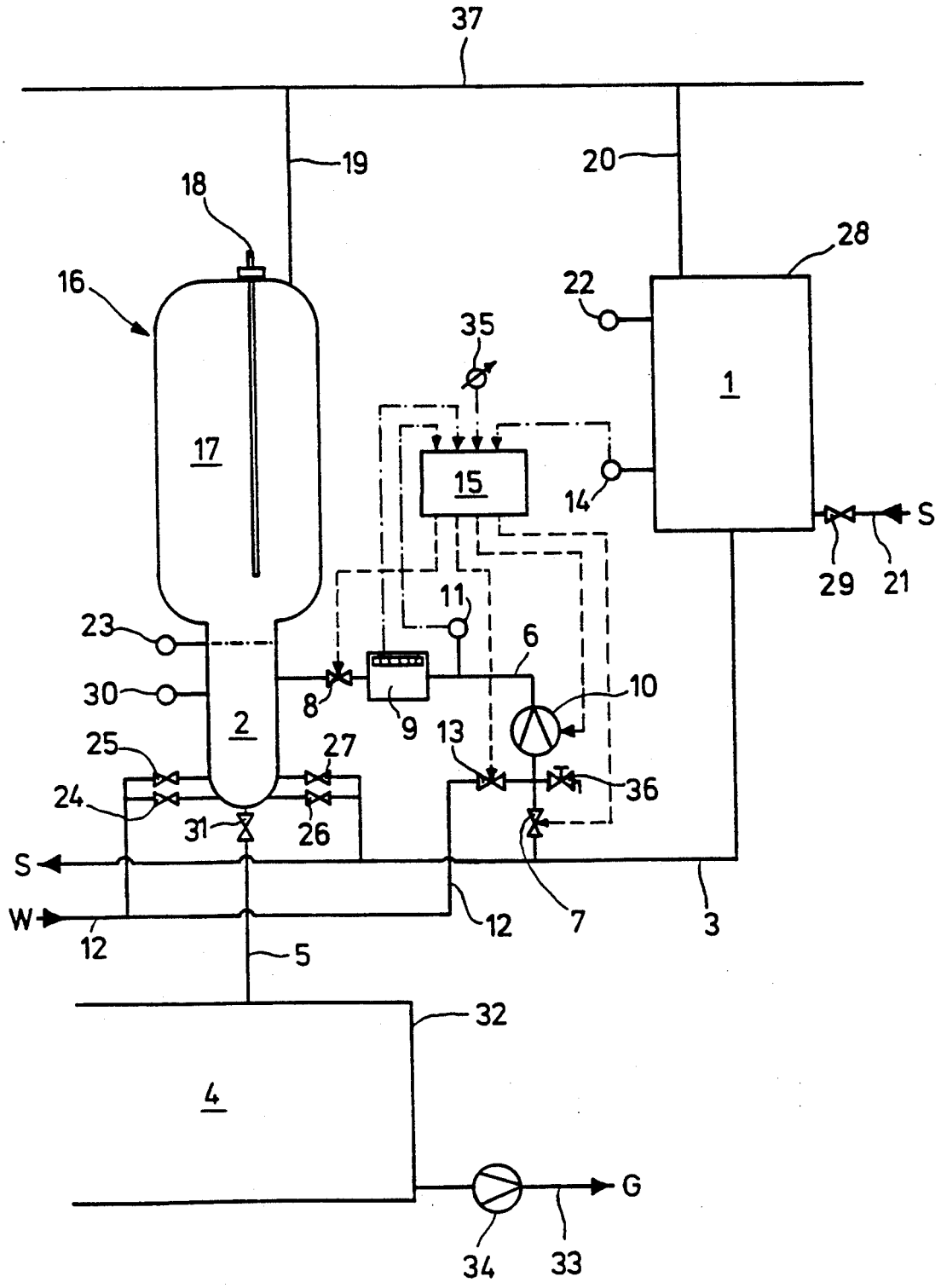
37
19
20
18
28
16
22
35
1
17
15
14
S
29
21
11
23
6
30
8
10
2
9
13
25
27
36
24
31
26
S
W
12
12
7
3
5
32
4
G
34
33

PROCESS AND DEVICE FOR THE MIXING OF BEVERAGE COMPONENTS

The invention relates to a process and a device for mixing beverage components.

Such a process and device are known from DE-PS 31 32 706. The known device serves for mixing a smaller amount of syrup (first component) with a larger amount of water (second component). A measuring chamber of its own is provided for each component. The measuring chamber for water is provided with a filling level meter, via which the water volume is proportioned. The measuring chamber for the syrup corresponds in its volume to the syrup volume necessary for one batch and is completely filled for each mixing process. The measuring chamber for syrup is disposed below the measuring chamber for water and connected with it via a pipeline. During mixing of the components, water and syrup are at first introduced into their measuring chambers up to the predetermined level or up to the predetermined volume. Thereafter, the inlets are locked, the water is supplied from its measuring tank into the measuring tank for syrup via the pipeline, and both components are supplied from there into the collecting chamber connected downstream and mixed.

With a simple, clear-cut design, a batch-wise mixing of two beverage components can be achieved with relatively great accuracy with this known device. However, this is only the case if a sufficient quantity is present in the storage chamber for the syrup in order to make a complete filling of the measuring chamber for syrup possible. However, if the storage chamber only still contains an insufficient residual amount with the syrup supply running low or after the switching off of the syrup supply due to closing hours or a change-over to another beverage, either no processing is possible at all or the residual amount is provisionally ascertained by filling in water, an the required amount of water is added by means of tables and many manual interventions. Here, an exact observance of the mixing ratio is not possible and the quality of the beverage suffers from this.

The conditions in a process and a device according to the older German patent application P 41 14 673.5 are similar. In this device the measuring chamber with a specific volume for the syrup is combined to a receiving chamber for the complete amount of mixture with the measuring chamber with a filling level meter for the water, which is disposed above the same forming an enlargement of the cross-section enhancing a thorough mixing. A fixed filling level probe is disposed in the upper area of the measuring chamber for the syrup which defines the specific volume of the measuring chamber. During normal operation, syrup is first introduced into the lower measuring chamber until the fixed filling level probe is reached. Thereafter, water is also introduced into the lower measuring chamber, where a mixing with the syrup is already carried out until a specific amount of mixture recorded by the filling level meter is reached. This amount of mixture is then discharged into a collecting chamber through a pipeline connected to the lower side of the lower measuring chamber with a repeated thorough mixing.

Problems occur in this device, as well, if the syrup in the storage chamber is no longer sufficient for a complete filling of the measuring chamber.

The invention is based on the object of providing a process and a constructionally simple device for the batch-wise mixing of beverage components, with which partial amounts of the first components, whose volume is smaller than the volume of the measuring chamber can also be rationally processed with a constantly high mixing accuracy.

An exact observance of the desired mixing ratio is always possible by means of the exact measurement according to the invention of the residual amount of the first component, which is filled into the measuring chamber, with subsequent exact metering of the second component irrespective of the quantity of the residual amount contained in the storage chamber. Small residual amounts of the syrup or the like, whose economic processing has not been possible so far, can consequently also be reliably processed without loss of beverage quality.

The metering of the second component can be carried out by the metering means working in normal operation. According to a further development of the invention, the measurement of the second component is, however, carried out at the same point or with the same means with which the first component is measured during the so-called residual amount metering. Due to this, an especially exact and rational operation results.

An example of an embodiment of the invention is shown in the drawing, which is a schematic lateral view of a device for mixing beverage components. It is integrated in an only partially represented system for producing a refreshment.

The shown device is provided for mixing a first component in the form of syrup S and a second component in the form of deaerated water W and comprises a tank-shaped metering and mixing unit 16. A lower measuring chamber 2 with a circular cross-section is provided for the syrup in its interior, whose volume is limited at the level of the dash-dotted line by means of a fixed filling level probe 23. An upper receiving chamber 17 with a circular cross-section of larger diameter adjoins the measuring chamber from above forming an enlarging transition cross-section. A level meter 18 is disposed in the receiving chamber 17, which records the level of the mixture G consisting of syrup and water in the metering and mixing unit 16.

A feed line 12 for the deaerated water ends in the lower area of the measuring chamber 2 via two shutoff valves 24, 25 with different cross-sections, and an intermediate line 3 for the syrup ends in the lower area of the measuring chamber 2 via two further shut-off-valves 26, 27 with different cross-sections. The intermediate line 3 is connected to the bottom of a first tank 28 forming a storage chamber 1 for the syrup, which is positioned at a level higher than the measuring chamber 2. The first tank 28 is provided with a lower filling level probe 14 and an upper filling level probe 22 and is supplied via a syrup line 21 with a control valve 29. Moreover, the first tank 28 is connected to a $CO_2$ collecting line 37 via a line 20, in the same fashion as the metering and mixing unit 16 via a line 19.

The measuring chamber 2 comprises a further filling level probe 30 for controlling the filling rate below its filling level probe 23 determining the volume. Moreover, a drain pipe 5 with a shutoff valve 31 is connected to its lowermost point, which opens into a tank 32 with a collecting chamber 4 for the mixture. A further line 33 with a pump 34 leads from the tank 32 to a saturation tank (not shown) in which the mixture is impregnated with carbon dioxide and to which the $CO_2$ collecting line 37 is also connected.

A few further metering and mixing units (not shown) can be connected to the tank 32 with the collecting chamber 4 for the mixture, which correspond to the construction of the metering and mixing unit 16 described so far. In this fashion, different metering and mixing units can be alternatingly filled and emptied, and a simultaneous charging of the collecting chamber is possible.

An auxiliary line 6 is connected to the lowermost point of the intermediate line 3 for the syrup, which opens into the measuring chamber 2 of the metering and mixing unit 16. A first shutoff valve 7, a pump 10, an empty tank signalling probe 11, an inductive flow meter 9 and a second shutoff valve 8 are switched on one after the other, the latter and the flow meter 9 being located near the point where the auxiliary line 6 opens into the measuring chamber 2. The feed line 12 for deaerated water is connected to the auxiliary line 6 between the first shutoff valve 7 and the pump 10 via a further shutoff valve 13.

The empty tank signalling probe 11, the flow meter 9 and the lower filling level probe 14 in the first tank 28 are connected to the input side of a control means 15 via signal lines outlined in dash-dotted fashion. The filling level probe 14 is disposed in such fashion that it generates a signal when the residual amount of syrup in the storage chamber 1 is smaller than the volume of the measuring chamber 2 up to the upper filling level probe 23. The empty tank signalling probe is designed in such fashion that it generates a signal when the auxiliary line 6 is empty at this point, i.e. does not contain syrup or water. The three shutoff valves 7, 8, 13 and the pump 10 are connected to the output side of the control means 15 via control lines outlined in dash-dotted fashion. Moreover, the control means 15 comprises an actuator 35 with which the mixing ratio beween the two components can be adjusted.

The storage chamber 1 in the first tank 28 is kept largely filled in normal operation by means of the upper filling level probe 22 and the control valve 29 via the syrup line 21 which leads to a storage tank (not shown). The amount of syrup in the storage chamber 1 is then sufficiently large in order to repeatedly fill the measuring chamber 2 with syrup. In this case, the mixing of the two components S and W takes place without the cooperation of the control means 15 according to the following procedure—with closed shutoff valves 7, 8, 13 and switched off pump 10:

At first, the syrup is introduced into the measuring chamber 2 at a high speed with closed shutoff valve 31 from the first tank 28 via the intermediate line 3 and the opened shutoff valve 26 with larger cross-section, until the lower filling filling level probe 30 is reached. Thereafter, the valve 26 is closed again and the previously closed shut-off valve 27 with smaller cross-section is opened. Now, the syrup flows at a low speed into the measuring chamber until it reaches the upper filling level probe 23. Thereupon, the shutoff valve 27 is also closed. The measuring chamber 2 is now completely filled with syrup up to a predetermined volume.

Then, the shutoff valve 24 with larger cross-section, which has been closed up to now, is opened so that deaerated water flows into the measuring chamber 2 at a high speed via a pump (not shown) and the feed line 12. The water is mixed with the syrup and the mixture rises in the receiving chamber 17 up to a specific filling level recorded by the filling level meter 18. Thereafter the shutoff valve 24 is closed again, and the shutoff valve 25 with a smaller cross-section, which has been closed up to now, is opened. Due to this, the water is introduced into the measuring chamber 2 at a low speed, namely until a predetermined filling level of the mixture in the receiving chamber 17 is reached, which is again recorded by the filling level meter 18. Instead of the use of the filling level meter 18, the control of the water inflow can of course also be taken over by several fixed filling level probes. With the reaching of the predetermined filling level in the receiving chamber 17, which depends on the desired mixing ratio between syrup and water, the metering of syrup and water is completed, and a first mixing of the two components has already taken place. The complete mixture batch is now introduced into the collecting chamber 4 of the tank 32 by opening shutoff valve 31 which has been closed so far, and is further mixed. The mixture that forms in the collecting chamber 4 is subsequently transported to the impregnating tank (not shown) via the line 33 and the pump 34, where it is enriched with carbon dioxide, and it is then ready for filling into containers.

If the syrup in the storage tank (not shown) runs low, the syrup line 21 is shut off, e.g. prior to the termination of work or prior to a change-over of the system to another beverage, the filling level in the first tank 28 gradually drops below the lower filling level probe 14. The residual amount of syrup located in the storage chamber 1 is now no longer sufficient for a complete filling of the measuring chamber 2. The filling level probe 14 emits a corresponding signal and activates the control means 15. At the same time, the control (not shown) for the aforementioned, normal mixing process is switched off, either manually due to a signal emitted by the filling level probe 14 or automatically by the control means 15. Now, at the latest, the shutoff valves 24 to 27 and the shutoff valve 31 are closed. The mixing of the two components now takes place under the influence of the control means 15 and in accordance with the process described in the following:

At first, the shutoff valves 7 and 8 are opened; the pump 10 is switched on and the flow meter 9 is activated; the shutoff valve 13 remains closed for the time being. Thereupon, the residual or partial amount of the syrup present in the storage chamber 1 and in the intermediate line 3 is almost completely introduced into the measuring chamber 2 via the auxiliary line 6 until the auxiliary line 6 is also emptied up to the empty tank signalling probe 11, and this probe emits a control signal. Thereafter, the two valves 7 and 8, however at least the valve 7, are closed, and the amount of syrup recorded by the flow meter 9 is indicated and signalled to the control means 15. This control means computes the necessry amount of water from the measured amount of syrup and the adjusted mixing ratio. This amount of flow is preset for the flow meter 9, and water from the feed line 12 is introduced into the measuring chamber 2 via the auxiliary line 6 by opening the valves 13 and possibly 8. When the predetermined amount is reached at the flow counter 9, it causes immediately a closing of the shutoff valves 8 and 13 and a shutting off of the pump 10. Now, the partial amount of a normal, complete batch with the same mixing ratio of the two components is located in the metering and mixing unit 16. This partial batch is subsequently introduced into the collecting chamber 4 in the customary fashion via the drain pipe 5 by opening the shutoff valve 31. The remaining amount of water in the additional line 6 can be drained by opening a drain cock 36 between the shutoff valve 7 and the pump 10.

The process described above can also be carried out if sufficient syrup for a complete batch is certainly present, but if only a partial batch is to be mixed for other reasons, e.g. if only a specific number of bottles must still be filled. In this case, the changeover is carried out by hand and not automatically by the filling level probe 14. Moreover, a simple exact "calibration" of the filling level probes 23, 30 and of the filling level meter 18 is possible by means of the flow meter 9.

The carrying out of the process according to the invention was described above in connection with a device, in which the measuring chamber for the syrup is connected with the measuring chamber for the water or for the mixture, which is disposed above the measuring chamber for the syrup via a transition area with enlarging cross-section. There are two possibilities in a device, in which the connection of these two measuring chambers is effected via a line with a shutoff valve: If the shutoff valve is opened during the metering, the process takes place in the fashion already described, since, then, the mixture can rise from the lower measuring chamber for the syrup into the upper measuring chamber. If, on the other hand, the shutoff valve is closed, the water is separately metered after the partial filling of the lower measuring chamber with syrup in the upper measuring chamber for the water, e.g. by the anyhow present filling level meter for normal operation or by the flow meter for the syrup. For this purpose, a further line with a shutoff valve is connected to the auxiliary line behind the flow meter, which opens directly into the upper measuring chamber for the water.

We claim:

1. In a method for mixing at least two beverage components in predetermined ratios in which a first component is fed into a measuring chamber having a specific volume from a first component storage chamber and a predetermined amount of a second component is then metered into and through said measuring chamber in accordance with said volume of the first component and the desired mixing ratio to form a mixture of said two components, said mixture then being discharged to a collecting chamber, the improvement comprising sensing the volume of said first component in said storage chamber and, when the residual volume of the first component in said storage chamber falls below the specific volume of the measuring chamber, measuring the amount of the first component being fed into the measuring chamber from the first component storage chamber and thereafter metering the amount of the second component being fed to the measuring chamber in accordance with said measured amount of the first component and the desired mixing ratio.

2. The method of claim 1, wherein the amount of the first component being fed to the measuring chamber is measured at a measuring point between the storage chamber and the measuring chamber.

3. The method of claim 2, wherein the measuring point for the first component is located adjacent the inlet of the first component into the measuring chamber.

4. The method of claim 2, wherein the amount of the first component and the flow of the second component are measured and metered, respectively, one after the other at the same measuring point.

5. The method of claim 2, wherein the residual volume of the first component in the storage chamber is substantially fed into the measuring chamber.

6. The method of claim 5, wherein the flow of the residual volume of the first component into the measuring chamber is stopped shortly before the last of the residual volume has reached the measuring point.

7. The method of claim 1, wherein the metering of the second component is carried out by metering the flow thereof at a measuring point.

8. The method of claim 7, wherein the measuring point for the second component is located adjacent the inlet of the second component into the measuring chamber.

9. In an apparatus for mixing at least two beverage components in predetermined ratios including a storage chamber for a first component, a measuring chamber of specific volume, means for filling said measuring chamber with said specific volume of said first component and means for metering a predetermined amount of a second component into and through said measuring chamber in accordance with said specific volume of the first component and the desired mixing ratio to form a mixture thereof and a collecting chamber for receiving said mixture, the improvement comprising means for sensing the volume of said first component in said storage chamber, control means activated by said sensing means when the volume of said first component in said storage chamber falls below said specific volume and means responsive to the control means for then measuring the amount of the first component flowing to the measuring chamber and thereafter for metering the amount of the second component flowing to the measuring chamber in accordance with said measured amount of the first component and the desired mixing ratio.

10. The apparatus of claim 9, including a main flow line and a separate auxiliary flow line for feeding said first component from said storage chamber to said measuring chamber, said control means closing said main flow line and opening said separate auxiliary flow line when activated by said sensing means and a flow meter in said auxiliary line responsive to the control means for measuring the amount of the first component flowing through said auxiliary flow lien and pump means upstream of the flow meter.

11. The apparatus of claim 10, including an empty line signalling probe in the auxiliary flow lien upstream of the flow meter and downstream of the pump means and connected to the control means for sensing the end of the flow of the first component in the auxiliary flow line.

12. The apparatus of claim 11, wherein the control means connects the flow of the second component to the auxiliary flow line upstream of the flow meter upon receiving a signal from said probe, said flow meter metering the amount of the second component thereafter flowing to the measuring chamber.

* * * * *